United States Patent [19]

Landsberger

[11] Patent Number: 5,076,445

[45] Date of Patent: Dec. 31, 1991

[54] CIRCULAR, COLLAPSIBLE RACK FOR CUVETTES AND LIKE VESSELS

[76] Inventor: David Landsberger, 52 Washburn Pl., Caldwell, N.J. 07006

[21] Appl. No.: 395,645

[22] Filed: Aug. 18, 1989

[51] Int. Cl.[5] ..... A47B 73/00

[52] U.S. Cl. ..... 211/74; 211/60.1

[58] Field of Search ..... 211/74, 60.1, 69.1, 211/69.8, 70.6, 71

[56] References Cited

U.S. PATENT DOCUMENTS

| | | | |
|---|---|---|---|
| 877,145 | 1/1908 | Waddell | 211/60.1 X |
| 1,273,622 | 7/1918 | Kollman | 211/74 X |
| 1,283,389 | 10/1918 | Wills et al. | 211/74 X |
| 1,538,849 | 5/1925 | Eger | 211/70.6 |
| 1,716,868 | 6/1929 | Stephens | 211/74 |
| 2,193,727 | 3/1940 | Jouffray | 211/60.1 X |
| 2,510,591 | 6/1950 | Listman | 211/74 X |
| 3,176,504 | 4/1965 | Shapiro | 211/60.1 X |
| 3,379,315 | 4/1968 | Broadwin | 211/74 |

*Primary Examiner*—Carl D. Friedman
*Assistant Examiner*—Sarah A. Lechok
*Attorney, Agent, or Firm*—Anthony F. Cuoco

[57] ABSTRACT

A circular collapsible rack for cuvettes and like vessels such as test tubes is disclosed which features a flat base and likewise flat upper and lower vessel support members of a suitable plastic material. The base has a plurality of equally spaced circumferential arms which are bent upward and substantially normal to its bottom via natural hinges. The arms include apertures for receiving tabs on the upper and lower support members, whereby said members are snapped into the base so as to be removably and adjustably supported thereby. With the disclosed arrangement the base and the upper and lower support members may be stored and shipped in the flat state so as to reduce storage space and shipping costs, and the assembled rack may accommodate a variety of vessel quantities and sizes, as is desirable.

7 Claims, 2 Drawing Sheets

CIRCULAR, COLLAPSIBLE RACK FOR CUVETTES AND LIKE VESSELS

BACKGROUND OF THE INVENTION

Various laboratory and processing procedures require that cuvettes and other like vessels such as test tube be supported in racks and the racks, in turn, be disposed in beakers or the like. Currently available racks for the purposes described are of a unitary construction. This requires more storage space than is desirable and increases shipping costs, as the case may be. Further, the vessel support portions of these racks are not removable, which detracts from their versatility in accommodating a variety of vessel sizes and desired holding capacities. Moreover, if the racks are of a molded plastic material, as is common in the art, the molds for such unitary racks are costly and add to the ultimate cost of the rack.

Accordingly, a need has been recognized for a circular rack which overcomes the aforenoted disadvantages of the prior art racks.

The present inventor is aware of the following U.S. Pat. Nos. in Class 211, Sub-classes 73X, 74 and 74X which relate generally to test tube racks: 1,021,998 (1912); 1,188,146 (1916); 1,054,035 (1913); 3,062,380 (1962); 3,390,783 (1968); 3,379,315 (1968); and 3,474,913 (1969). However, none of these racks are circular so as to serve the purposes intended and are otherwise structurally different from the herein disclosed invention.

SUMMARY OF THE INVENTION

This invention contemplates a circular, collapsible rack for cuvettes and like vessels such as test tubes. The rack includes a base which removably supports upper and lower vessel support members. The base is fabricated of a suitable plastic material as a flat member having a plurality of arms extending therefrom, and which arms are bendable substantially normal to the bottom of the base via a natural hinge. The upper and lower support members have discretely spaced tabs which are received in snap-fit relation in corresponding discretely spaced apertures in the arms when the arms are bent, whereupon the rack is formed.

The bottom of the base is a flat open grid. The upper and lower support members are flat open grids corresponding in size and pattern so that a plurality of vessels fit through said grids for being supported by said upper and lower support members. Since the base and support members may be shipped and stored flat, shipping costs and storage space are reduced.

The upper and lower support members are removable, whereby the base can support a variety of said members having grids of a variety of corresponding sizes and patterns.

A rack of the type described may be disposed in a beaker with its base adjacent the bottom of the beaker and with a suitable clearance between the beaker circumference and the bent arms of the rack which support the upper and lower support members.

BRIEF DESCRIPTION OF THE DRAWINGS

FIG. 3 is an elevational view showing a rack according to the invention disposed in a beaker or the like.

DETAILED DESCRIPTION OF THE INVENTION

Figure 1:
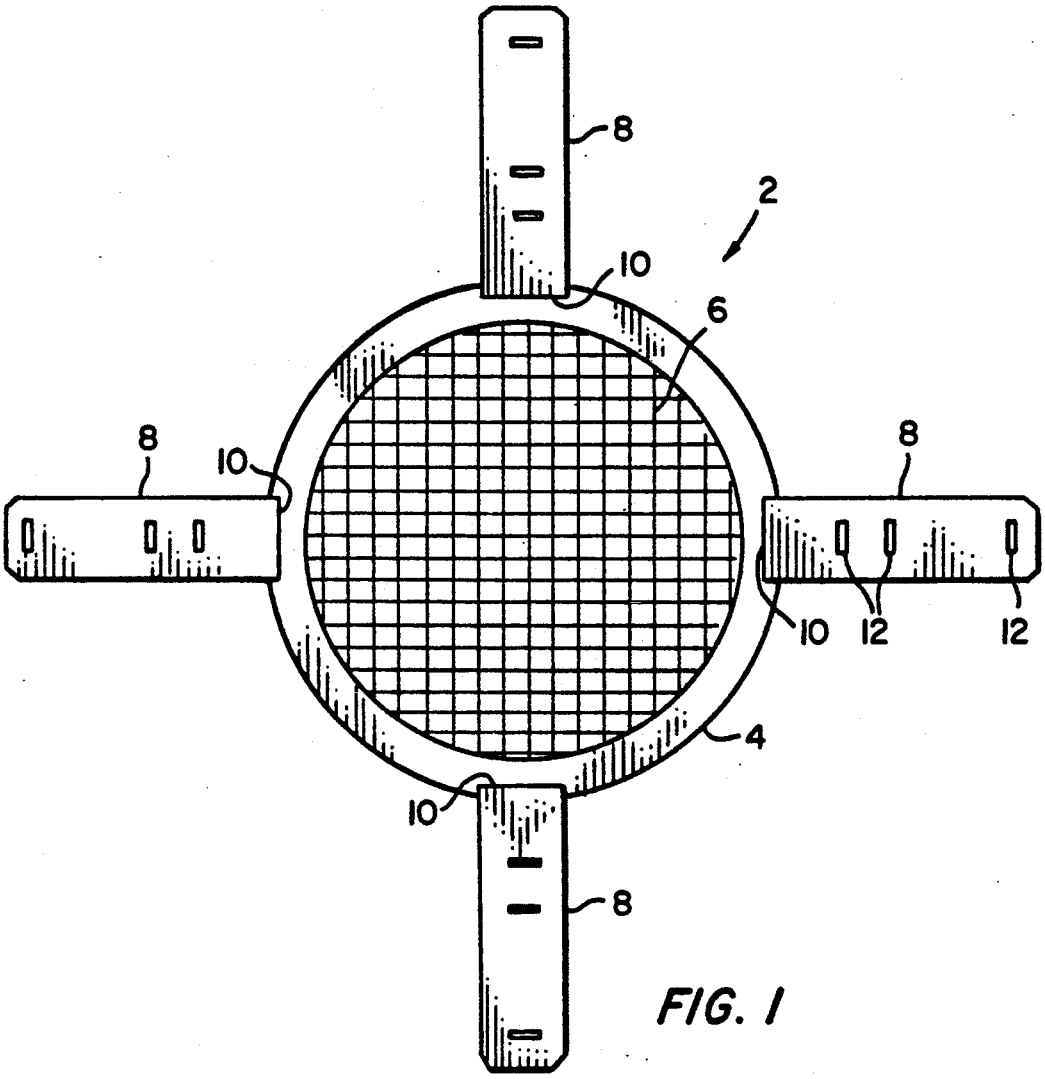
FIG. 1 is a plan view of a base for a rack according to the invention.

With reference particularly to FIG. 1, a rack base is designated generally by the numeral 2. Base 2 has a solid substantially circular frame 4 surrounding an open grid 6 which serves as the bottom of the base as will hereinafter become evident.

A plurality of arms 8 shown, for purposes of illustration, as four in number are equally spaced around the circular circumference of base 4.

In the preferred embodiment of the invention, base 2 is molded as a flat member of a suitable plastic material such as polypropylene with a ten percent talc content for weighting purposes. In forming the rack, arms 8 are bent upward and substantially normal to bottom 6 as particularly shown in FIG. 2. In this regard it will be understood that arms 8 extend from base frame 4 so as to form a natural hinge therewith as at 10, whereby the aforenoted bending is facilitated as is well known in the plastics fabrication art.

Each of the arms 8 has a plurality (shown as three in number for illustration purposes) of horizontally and vertically aligned relatively small, substantially rectangular discretely spaced upper and lower apertures 12. Apertures 12 have a purpose which will be hereinafter described.

Figure 2:
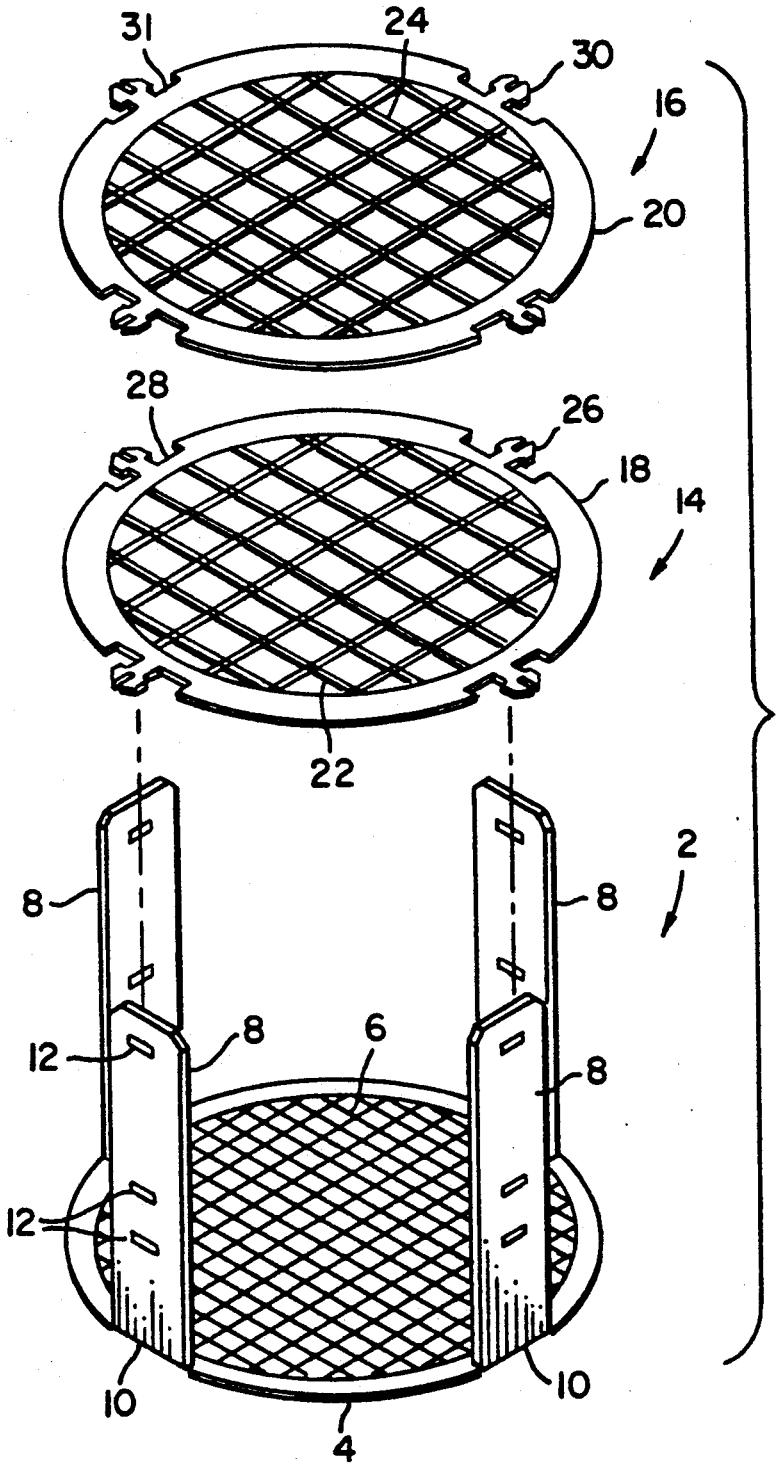
FIG. 2 is an exploded view showing arms integral with the base of the rack and bent normal to the bottom thereof, and further showing upper and lower vessel support members according to the invention.

With reference to FIG. 2 a lower support member is designated by the numeral 14 and an upper support member is designated by the numeral 16. Support members 14 and 16 are substantially circular in shape and include solid circumferential frames 18 and 20, respectively, surrounding open grids 22 and 24, respectively. The size and pattern of grid 22 and the size and pattern of grid 20 must coincide, as will be hereinafter more fully explained.

Frame 18 has a plurality of shoulder tabs 26 which are shown as four in number and are equally spaced around the circumference of the frame, being disposed in frame interruptions 28. Likewise, frame 20 has a corresponding plurality of equally spaced shoulder tabs 30 spaced in interruptions 31 of the frame. It will be seen with reference to FIG. 2 that tabs 26 and 30 are spaced alike and the spacing corresponds to the circumferential spacing of apertures 12 on arms 8 when the arms are bent normal to base 6 as heretofore described.

As particularly shown in FIG. 2, in providing the rack of the invention lower support member 14 is disposed inside arms 8 which are bent upward and normal relative to base 6 so that tabs 26 are received by either the lowermost aperture 12 or the next higher aperture 12 in arms 8. In this connection it will be understood that tabs 26 are snapped into the appropriate apertures 12 so that lower support member 14 is supported around its circumference. Similarly, upper support member 16 is disposed inside arms 8 so that tabs 30 are received by the uppermost aperture 12 in arms 8, whereupon said tabs are snapped into said apertures so that upper support member 16 is supported around its circumference above lower support member 14.

As heretofore noted, the spacing and pattern of lower and upper support member grids 22 and 24 must correspond so that vessels to be supported thereby are axially displaced first through upper support member grid 24 and then through lower support member grid 22. The spacing and pattern of base grid 6 need not correspond to that of grids 22 and 24 since the purpose of grid 6 is merely for draining or the like as will now be understood by those skilled in the art.

Figure 3:
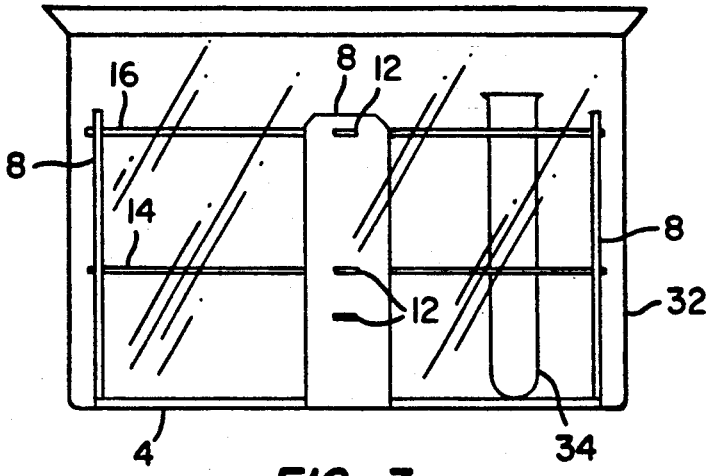

With particular reference to FIG. 3, a rack fabricated and assembled as aforenoted may be disposed in a beaker or like substantially circular container designated by the numeral 32. In this event, the bottom of base 4 is adjacent the inside bottom of beaker 32 and a suitable clearance between arms 8 and the circumference of the beaker is maintained. A plurality of cuvettes or like vessels such as 34 are supported by the rack.

In further description of the invention it will be understood that the disclosed rack features ease of manufacture and maximum versatility. For example, apertures 12 on arms 10 may be provided in sufficient quantity and in sufficient spaced relation so that the space between lower support member 14 and bottom 4 and between the lower support member and upper support member 16 can be varied as the case may be. Further, fabrication of the invention, which in the preferred embodiment thereof is of a molded plastic construction as aforenoted, is simplified. That is to say, base member 2, lower support member 14 and upper support member 16 may be molded as flat members to reduce mold costs. Further, these members may be stored and shipped in the flat state to reduce required storage space and shipping costs as will now be understood. Additionally, the rack as described is easily cleaned and is readily autoclavable as is desired. Finally, a plurality of different upper and lower support members may be supported by the rack base to further enhance the use of the invention.

With the above description of the invention in mind reference is made to the claims appended hereto for a definition of the scope of the invention.

What is claimed is:

1. A rack for cuvettes and like vessels, and adapted for being disposed in a substantially circular container, comprising:

a substantially circular base including a draining bottom and a plurality of integral, bendable arms equidistantly disposed around the bottom;

the arms being bent for extending upwardly and substantially normal to the bottom, and each of said arms carrying a plurality of discretely spaced, horizontally and vertically aligned upper and lower apertures;

a substantially circular upper vessel support member having a plurality of tabs circumferentially spaced so as to correspond to the spacing of the upper apertures in the upwardly extending arms;

a substantially circular lower vessel support member having a plurality of tabs spaced so as to correspond to the spacing of the lower apertures in the upwardly extending arms; and the upper and lower vessel support members being disposed within the upwardly extending arms, whereupon the tabs of said upper and lower vessel support members are received in snap fit relation by the respective upper and lower apertures so that said vessel support members are removably supported by the base, with the lower vessel support member adjustably supported thereby, to form a substantially circular rack adapted to be disposed in a substantially circular container.

2. A rack as described by claim 1, wherein:

the upper and lower vessel support members include flat open grids corresponding in size and pattern for supporting vessels axially displaced first through the grid of the upper vessel support member and then through the grid of the lower vessel support member.

3. A rack as described by claim 1, wherein:

the base is initially flat and of a material so that the integral, bendable arms extend in a natural hinge arrangement from the bottom thereof, whereby said integral bendable arms are bent substantially normal to said bottom.

4. A rack as described by claim 2, wherein:

the draining bottom includes a flat open grid of a size and pattern different than that of the upper and lower support members.

5. A rack as described by claim 1, wherein:

the plurality of discretely, horizontally and vertically aligned upper and lower apertures carried by each of the arms includes one upper aperture and at least two lower apertures.

6. A rack as described by claim 5, wherein:

the corresponding tab of the upper vessel support member is received in snap fit relation in the one upper aperture and the corresponding tab of the lower vessel support member is received in snap fit relation in one of the two lower apertures carried by each of the arms, whereby the upper and lower vessel support members are removably supported by the base, with the lower vessel support member being adjustably supported thereby.

7. A rack for cuvettes and like vessels, and adapted for being disposed in a substantially circular container, comprising:

a substantially circular base including a draining bottom and a plurality of integral, bendable arms equidistantly disposed around the bottom and extending therefrom;

a base initially flat and of a material so that the integral, bendable arms extend in a natural hinge arrangement from the bottom thereof, whereby said arms are bent substantially normal to the bottom;

the draining bottom includes a flat open grid;

upper and lower vessel support members including flat open grids corresponding in size and pattern;

each of said arms carrying a plurality of discretely spaced, horizontally and vertically aligned upper and lower apertures, said plurality of apertures including one upper aperture and at least two lower apertures;

the upper vessel support member including a plurality of tabs spaced so as to correspond to the discrete spacing of the upper apertures;

the lower vessel support member including a plurality of tabs spaced so as to correspond to the discrete spacing of the lower apertures; and the upper and lower vessel support members being disposed within the bent arms, whereupon the tabs of said upper and lower vessel support members are received in snap fit relation by the respective upper and by one of the respective lower apertures carried by each of the arms so that said vessel support members are removably supported by the base, with the lower vessel support member being adjustably supported thereby, to form a substantially circular rack adapted to be disposed in a substantially circular container.

* * * * *